US007460812B2

(12) United States Patent
Lewis et al.

(10) Patent No.: US 7,460,812 B2
(45) Date of Patent: Dec. 2, 2008

(54) GANG SAFETY LATCHING MECHANISM AND AN IMAGE PRODUCING MACHINE INCLUDING SAME

(75) Inventors: Carl B. Lewis, Webster, NY (US); Carlos M. Terrero, Ontario, NY (US); John L. Howard, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 372 days.

(21) Appl. No.: 11/370,284

(22) Filed: Mar. 8, 2006

(65) Prior Publication Data

US 2007/0212107 A1 Sep. 13, 2007

(51) Int. Cl.
*G03G 15/00* (2006.01)
*B61L 29/08* (2006.01)
*E05F 1/14* (2006.01)

(52) U.S. Cl. ..... 399/110; 49/282; 16/289

(58) Field of Classification Search ..... 399/107, 399/110, 125; 16/289; 49/282, 285
See application file for complete search history.

(56) References Cited

U.S. PATENT DOCUMENTS 4,295,732 A 10/1981 Hull et al.
4,385,423 A 5/1983 Vermilye
5,162,846 A * 11/1992 Cahill ..... 399/125
5,449,298 A 9/1995 Fetterolf, Sr. et al.
5,470,115 A 11/1995 Berg et al.
6,347,819 B1 2/2002 Plaxco
6,499,189 B2 * 12/2002 Kondo et al. ..... 16/289
6,510,301 B2 * 1/2003 Tanaka ..... 399/125
2002/0061206 A1 * 5/2002 Enomoto et al. ..... 399/124
2005/0134940 A1 * 6/2005 Shyu ..... 358/474

* cited by examiner

*Primary Examiner*—David M Gray
*Assistant Examiner*—Joseph S. Wong
(74) *Attorney, Agent, or Firm*—Tallam I. Nguti

(57) ABSTRACT

A gang safety latching mechanism includes (a) a torsion spring and bracket device having (i) a torsion spring subassembly (ii) a first bracket on the torsion spring subassembly having a first free position and a first loaded position, and (iii) a second bracket on the torsion spring subassembly having a second free position and a second loaded position; (b) an interference assembly defining a receiving area and including (i) an opening for passage of an end portion of the torsion spring and bracket device into and out of the receiving area, (ii) a knocker member for contacting the first bracket and (iii) a catch lip for trapping the second bracket within the receiving area; and (c) a gang locking member for locking the second bracket to the first bracket, thereby preventing unsafe separate simultaneous movement of the second movable and the first movable module relative to the main machine body.

18 Claims, 7 Drawing Sheets

GANG SAFETY LATCHING MECHANISM AND AN IMAGE PRODUCING MACHINE INCLUDING SAME

This invention relates to a gang safety latching mechanism for preventing unsafe separate simultaneous movement of plural movable co-assembled bodies, and more particularly to an image producing machine including the same.

Image producing machines, for example high speed electrostatographic reproduction machines typically comprise modular assemblies. These modular assemblies typically also include copy sheet handling modules that are individually mountable relative to a host machine, and that are movable linearly or pivotably and separately relative to each other and/or to the host machine in order to provide operator access to necessary operator functions on or within the modules or host machine.

In some of these machines, the architecture may involve one module mounted on another, for example, a bypass sheet transport module being mounted on a sheet compiler input transport module, each of which is movable relative to the other and to another reference module. A typical operator function that requires movement of these modules is jam clearance.

Jam clearance for example may and often requires moving more than one such modules, for example, it may require (i) that the compiler input transport module is opened to clear the compiler area, (ii) that the bypass transport also be opened to clear the compiler input transport itself; and (iii) that a cover to, or the upper portion of the bypass transport module further also be opened to clear the bypass transport module itself. Typically, the two main transport modules in this example, (the bypass transport module and the compiler input transport module) can open 60 and 75 degrees respectively relative to the reference module on which they are mounted. Because each of these modules as mounted is counterbalanced, the ability to open both of them simultaneously tends to undesirably affect the center of gravity of the joint mass being moved, thereby causing the counterbalances to briskly open the both modules in an unsafe manner to their open positions. It should be noted that to both modules when opened simultaneously thus will amount to a vigorous travel through an angle of 135 degrees for the bypass transport module. Such vigorous travel by the bypass transport module, past vertical, runs a significant risk of causing injury to an operator, and/or damage to the hardware or surrounding objects.

In general, the problem described here with such co-assembled modules of an image, producing machine, may also be encountered in similar environments including plural co-assembled and movable modules that similarly may have to be moved separately and simultaneously by an operator in order to perform an operator function.

As disclosed for example in the following references, it is known to attempt to use latching mechanisms in order to lock one component to another. U.S. Pat. No. 4,295,732 issued Oct. 20, 1981 and entitled "Bound document apparatus latching mechanism" discloses a double latch arrangement for use in a reproduction system having a document handling device for the circulation of individual document sheets onto a copying exposure platen and a separate bound document copying apparatus. The latching mechanism is devised which will secure together both the document handling device with the bound document copying apparatus so as to be movable as a unit relative to an exposure platen of the reproduction system, or to permit only the document handling device to be so moved.

Other examples of prior art safety latching mechanisms are disclosed in the following references: U.S. Pat. No. 6,347,819 issued February 2002 and entitled "Safety latching mechanism" discloses a latching assembly for securing a gate having a bolt extending therefrom. The latching assembly is provided with a housing and a bolt retaining member pivotally connected to the housing. The bolt retaining member has a retaining portion. The bolt retaining member has open and closed positions with the bolt retaining member being biased in the closed position. The latching assembly is further provided with a trigger connected to the housing. The trigger has locked and unlocked positions with the trigger being biased in the locked position. The trigger has a contact portion sized and configured to contact a bolt when the trigger mechanism is in the locked position. The trigger further has a locking portion sized and configured to engage the bolt retaining member when the bolt retaining member is in the open position and the trigger is in the locked position. The retaining portion and the contact portion are cooperatively sized and configured to retain a bolt therebetween when the bolt retaining member is in the closed position and the trigger is in the unlocked position.

U.S. Pat. No. 5,470,115 issued Nov. 28, 1995 and entitled "Recessed three-point latching mechanism and method for a storage locker" discloses a recessed three-point latching mechanism and method for a storage locker and a locker incorporating the same that utilizes a dead bolt system employing a pair of rotary actuated lock rods for engaging the top and bottom of the locker door opening in conjunction with a center latch engaging the door jamb. A lever, which may include a finger grip, is utilized for simultaneously unlocking the lock rods and unlatching the center latch and is accessible within a recessed cup for safety and security. The latching mechanism and method may also include a cam to hold the latching mechanism in a door open position until the door is closed to prevent damage to the locker face by the otherwise extended lock rods. The latching mechanism and method is compatible with either padlocks or a built-in lock secured within the recessed cup.

U.S. Pat. No. 5,449,298 issued Sep. 12, 1995 and entitled "Latching system for intermatable connectors" discloses a latching system for a pair of intermatable electrical connectors, such as a plug and receptacle, which incorporates a mechanism for unlatching same by the application of a maximum predetermined separating force, such as may be the result of an accident, to the plug and receptacle. The system comprises a first electrical connector having a pair of flexible arms projecting axially therefrom, where the free ends of the arms include slot means for engaging complementary arms within the second electrical connector. The second electrical connector includes a forward ramp surface against which the flexible arms initially ride to effect mating of the connectors, a rearward surface slightly angled, i.e. on the order of about 4 degree to 10 degree, from a base toward the ramp surface, and a metal spring arm mounted within the second electrical connector in close proximity to the base of the rearward surface. In the mated condition the spring arm engages the slot means. While a manually operated mechanism is provided to effect unmating, a safety system is included to prevent damage due to forces being applied thereto. For example, to effect unmating a maximum predetermined separating force may be applied therebetween causing the spring arm to flex to a position near the rearward surface at a critical release angle to thereby release the free end from its respective spring arm.

U.S. Pat. No. 4,385,423 issued May 31, 1983 and entitled "Over-center latching coupling" discloses an over-center latching device for coupling two members by the operation of a handle with the use of one hand. The device has a rod having a T at one end for engaging a hook, the other end of the rod being pivotally engaged intermediate the ends of the handle. One end of the handle is pivotally engaged on a support member adjacent and spaced from the pivot point of the rod. The other end of the handle is adapted to be gripped by the operator for completing the latching and unlatching operation. The support member which is adapted to be secured to a fixed member has a concave cam surface facing the pivoted end of the rod. The pivoted end of the rod has a leaf spring extending therefrom toward the concave cam surface. To engage the latch, the operator grips the handle and rotates it on its pivot so that the leaf spring is moved into engagement with the end of the cam surface. By the contact of the spring on the cam surface the rod is rotated so that the T-bar is moved toward the hook and as the spring is continued to be rotated on the cam the T-bar is rotated into latching engagement with the hook and the center of the rod pivot is moved over the center of the handle pivot to securely latch the rod and hook together to complete the coupling operation. A safety lock is also provided to maintain the coupling in the latched engagement.

In accordance with the present disclosure, there is provided a gang safety latching mechanism that includes (a) a torsion spring and bracket device having (i) a torsion spring subassembly (ii) a first bracket on the torsion spring subassembly having a first free position and a first loaded position, and (iii) a second bracket on the torsion spring subassembly having a second free position and a second loaded position; (b) an interference assembly defining a receiving area and including (i) an opening for passage of an end portion of the torsion spring and bracket device into and out of the receiving area, (ii) a knocker member for contacting the first bracket and (iii) a catch lip for trapping the second bracket within the receiving area; and (c) a gang locking member for locking the second bracket to the first bracket, thereby preventing unsafe separate simultaneous movement of the second movable and the first movable module relative to the main machine body.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
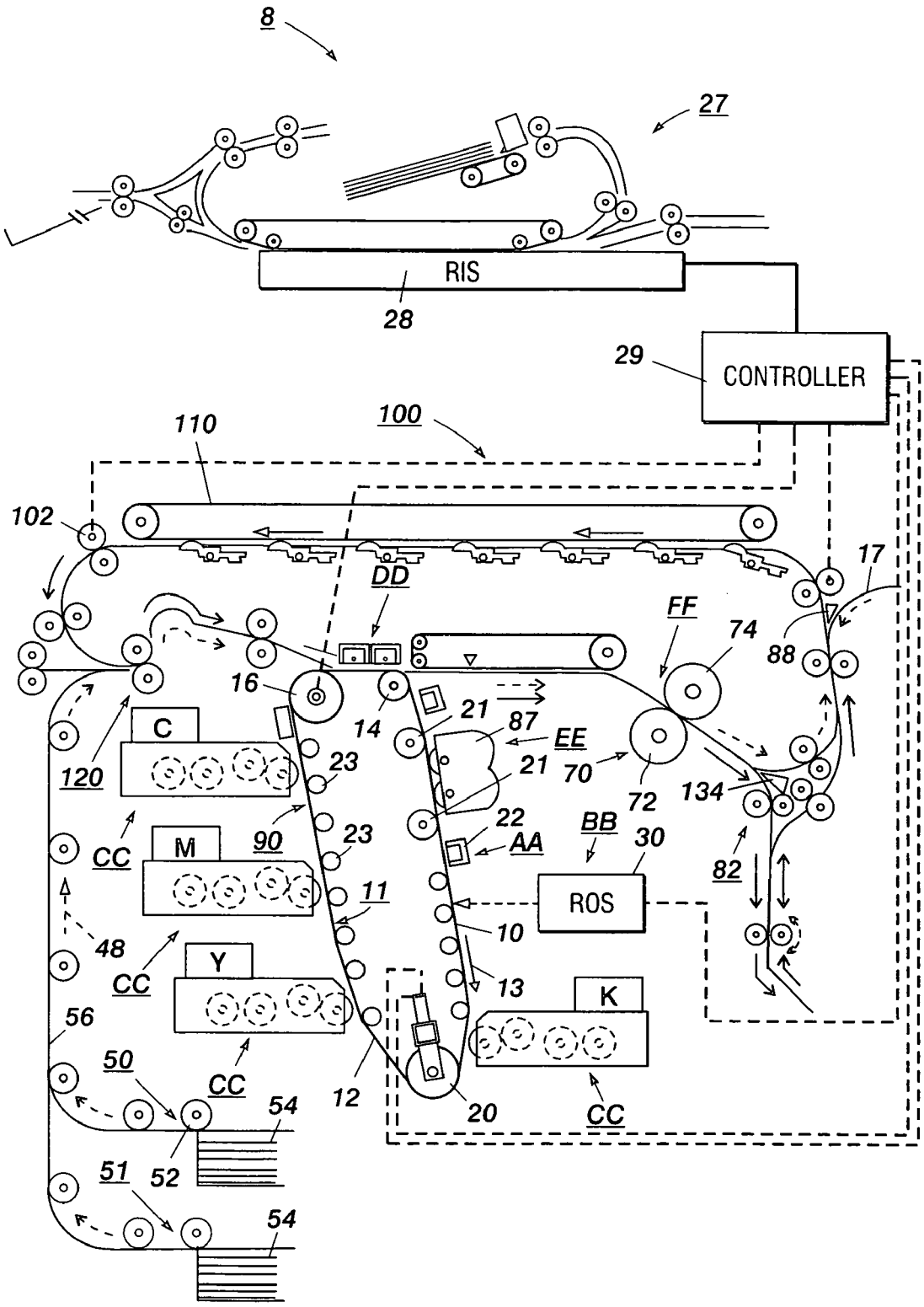
FIG. 1 is a schematic elevational view of a host machine such as an electrostatographic reproduction machine utilizing the gang safety latching mechanism of the present disclosure.

Referring now FIG. 1, it schematically illustrates a sheet-documents producing machine such as an electrostatographic reproduction machine 8 which generally employs a photoconductive belt 10 mounted on a belt support module 90. Preferably, the photoconductive belt 10 is made from a photoconductive material coated on a ground layer which, in turn, is coated on an anti-curl backing layer. Belt 10 moves in the direction of arrow 13 to advance successive portions sequentially through the various processing stations disposed about the path of movement thereof. Belt 10 is entrained as a closed loop 11 about stripping roll 14, drive roll 16, and idler roll 21.

Initially, a portion of the photoconductive belt surface passes through charging station AA. At charging station AA, a corona generating device indicated generally by the reference numeral 22 charges the photoconductive belt 10 to a relatively high, substantially uniform potential. As also shown FIGS. 1-4, the machine 8 includes a controller or electronic control subsystem (ESS), indicated generally be reference numeral 29 which is preferably a self-contained, dedicated mini-computer having a central processor unit (CPU), electronic storage, and a display or user interface (UI). The ESS 29, with the help of sensors and connections, can read, capture, prepare and process image data and machine status information. As such, it is the main control system for components and other subsystems of the machine 8 including the closed loop belt tensioning mechanism 200 of the present invention.

Referring again to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

The controller 29 is preferably a programmable microprocessor which can be programmed to provide various controls including for example a comparison count of the copy sheets, the number of documents being recirculated, the number of copy sheets selected by the operator, time delays, jam corrections, for example. The control of all of the exemplary systems heretofore described may be accomplished by conventional control switch inputs from the machine 8 consoles selected by the operator. Conventional sheet path sensors or switches may be utilized to keep track of the position of the document and the copy sheets.

ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four developer units containing cmyk color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station FF.

Fusing station FF includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush device 87 in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
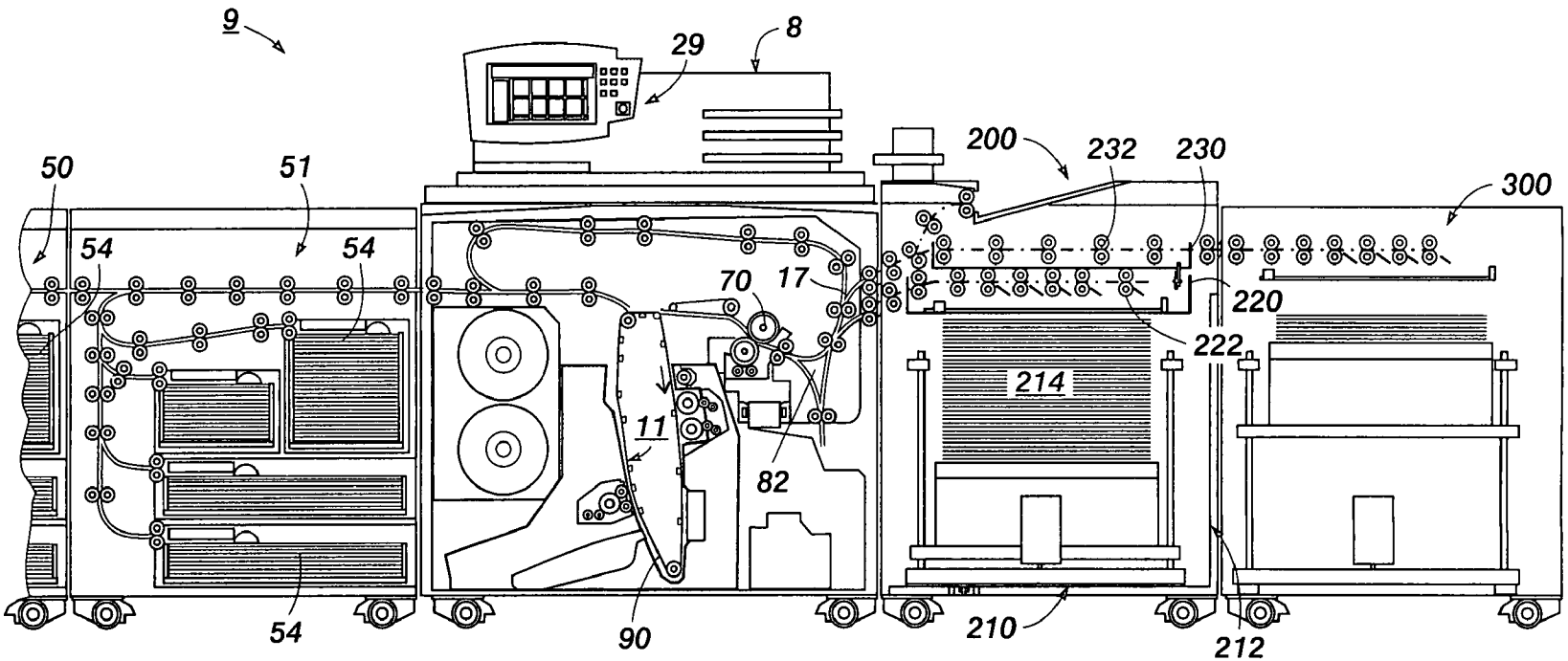
FIG. 2 is a schematic front elevational view of the machine of FIG. 1 including plural co-assembled movable modules utilizing the gang safety latching mechanism of the present disclosure.

Referring now to FIGS. 1 and 2, the sheet-documents producing machine 8 as shown includes plural sheet-copy documents finishing devices 200 and 300. Only two such devices 200 and 300 are shown, but it is understood that any plural number thereof may be used. As shown, the sheet-copy document finishing device 200 is for example a compiler 210 that includes a compiler housing 212 for receiving and compiling a stack 214 of sheets, and a compiler input transport module 220 for transporting sheets from the Image Output terminal 8 into the compiler housing 212. The compiler input transport module 220 includes sheet transport rolls 222, and is mounted on the compiler housing 212 for movement, (e.g. pivotable movement), relative to the compiler housing 212. Such movement could equally be up and down translational movement relative to the compiler housing 212.

For transporting sheets past the compiler 210 to the next sheet finishing device 300, the machine 9 of FIG. 2 includes a bypass transport module 230, that as shown, is mounted (fro example to and) on top of the compiler input transport module 220 for movement, (e.g. pivotable movement), relative to the compiler input transport module 220 and to the compiler housing 212. The bypass transport module 230 also includes sheet transport rolls 232, and ordinarily could be movable separately and simultaneously with the compiler input transport module 220, relative to the compiler housing 212. Such movement could equally be up and down translational movement relative to the compiler input transport module 220.

Thus the image producing machine 9 can be seen to include (a) a main machine body or image output terminal 8 having image forming and transfer components including a photoreceptor 10, sheet supply modules 50, 51, and a fusing apparatus 70; (b) several other modules 200, 300, including a reference module such as the compiler housing 212, and at least two movable modules such as the compiler input transport module 220 and bypass transport module 230 that are co-assembled to the reference module (compiler housing 212) for movement relative to each other and to the reference module (compiler housing 212). In order to prevent the compiler input transport module 220 and bypass transport module 230 from moving simultaneously but separately in an unsafe manner, the sheet-copy document finishing device 200 includes the gang safety latching mechanism 400 of the present disclosure.

Referring now to FIGS. 3-7, the gang safety latching mechanism 400 and its use are illustrated in detail. As shown, the gang safety latching mechanism 400 comprises (a) a torsion spring and bracket device 410 including (i) a torsion spring subassembly 412 for attaching to a first movable module, for example the compiler input transport module 220, of the at least two co-assembled movable modules, (ii) a first bracket 420 mounted onto the torsion spring subassembly 412, having a first free position FP1 and a first loaded position LP1, and being movable between the first free position and the first loaded position, and (iii) a second bracket 440 mounted onto the torsion spring subassembly 412, having a second free position FP2 and a second loaded position LP2, and being movable between the second free position and the second loaded position.

The gang safety latching mechanism 400 also includes an interference assembly 450 defining a receiving area 452. The interference assembly 450 is locatable on the reference module or compiler housing 212 and includes (i) an opening 454 for passage of an end portion 414 of the torsion spring and bracket device 410 into and out of the receiving area 452, (ii) a knocker member 456 for contacting the first bracket 420 when the end portion 414 (of the torsion spring and bracket device 410, is passed through the opening 454; and (iii) a catch lip 458 for trapping the second bracket 440 by means of a shoulder portion 442 thereof, within the receiving area 452. Although the interference assembly 450 is described here as a unitary assembly, it could be comprised of a first member acting as the knocker member 456 and of a second member acting as the catch lip 458. In fact the first member and second member as such could be portions or parts of the reference module or body 212 that are arranged or located apart to create an effective gap or opening 454 between them, into an open space between them that is sufficient to receive the lower or end portion 414 of the torsion spring and bracket device 410.

The gang safety latching mechanism 400 further includes a gang locking member 460, for example an attachable pin, locatable on a second movable module, such as the bypass transport module 230 of the at least two co-assembled movable modules, for locking the second bracket 440 to the first bracket 420, thereby gang locking the second movable module or bypass transport module 230 to the first movable module or compiler input transport module 220, and thereby preventing unsafe separate simultaneous movement of the second movable and the first movable module relative to the reference module.

Figure 5:
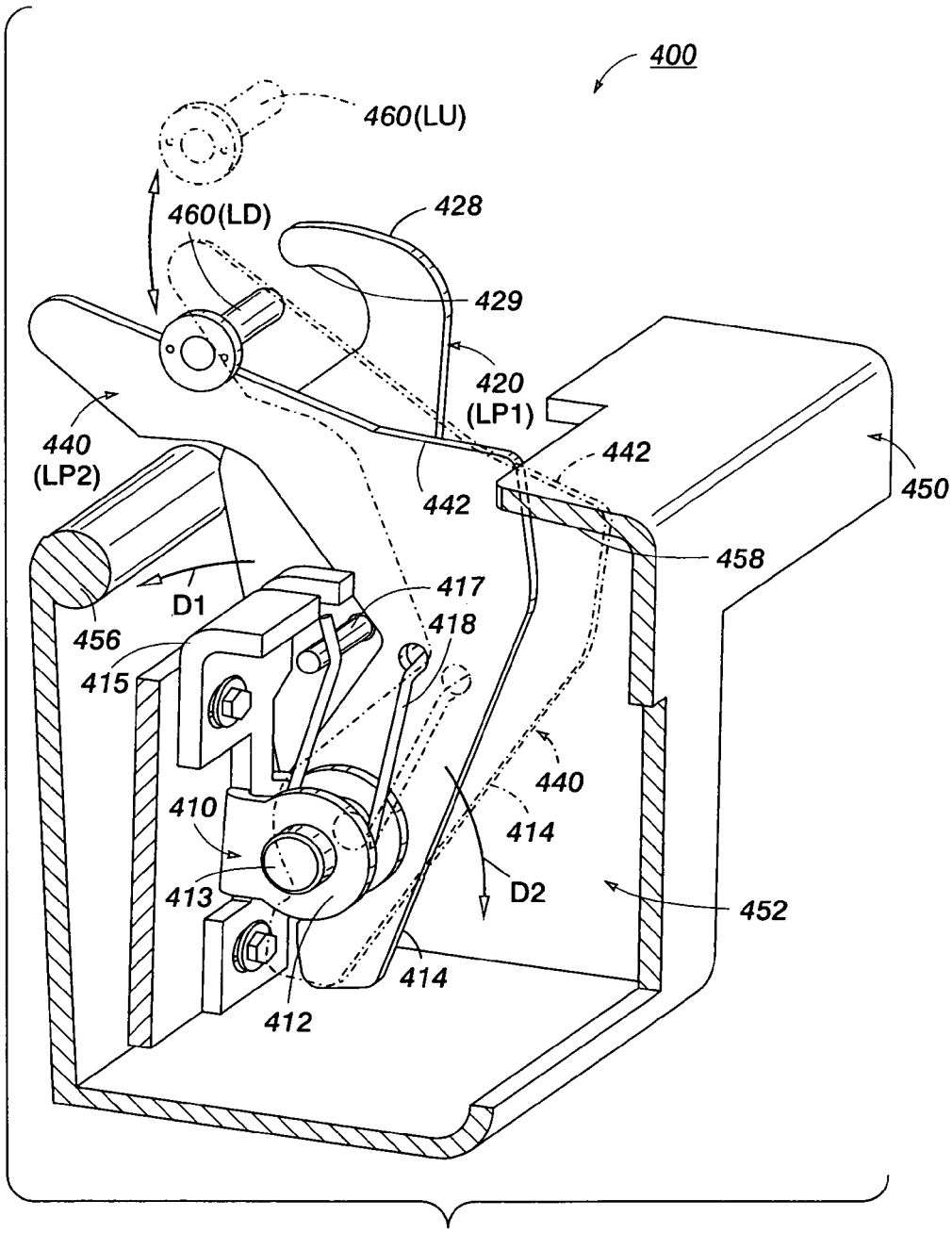
FIG. 5 is a perspective schematic of the gang safety latching mechanism of the present disclosure with both the first bracket and second bracket in their loaded positions.
Figure 6:
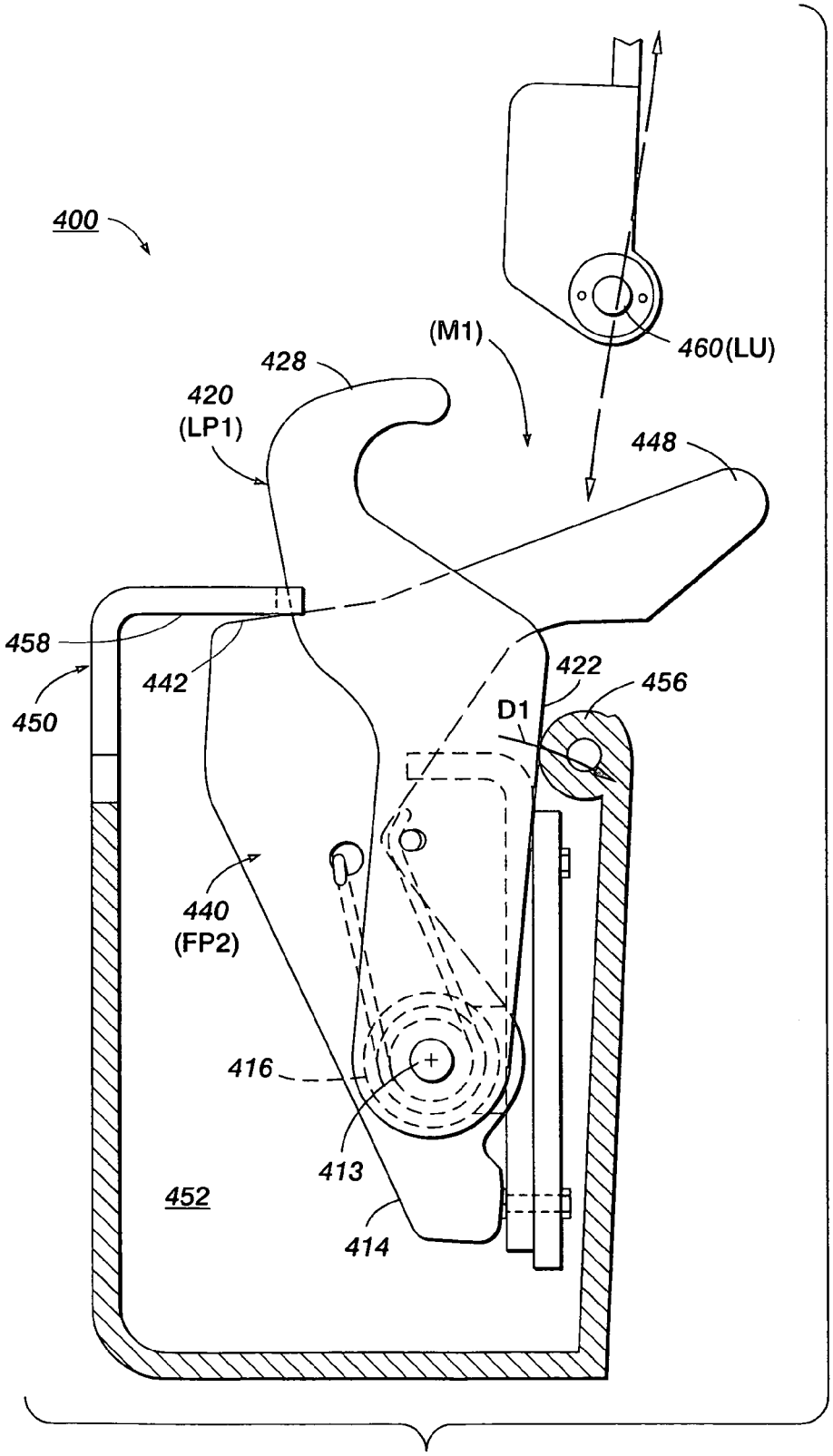
FIG. 6 is a perspective schematic of the gang safety latching mechanism of the present disclosure with the first bracket in its loaded position and the second bracket in its free position.
Figure 7:
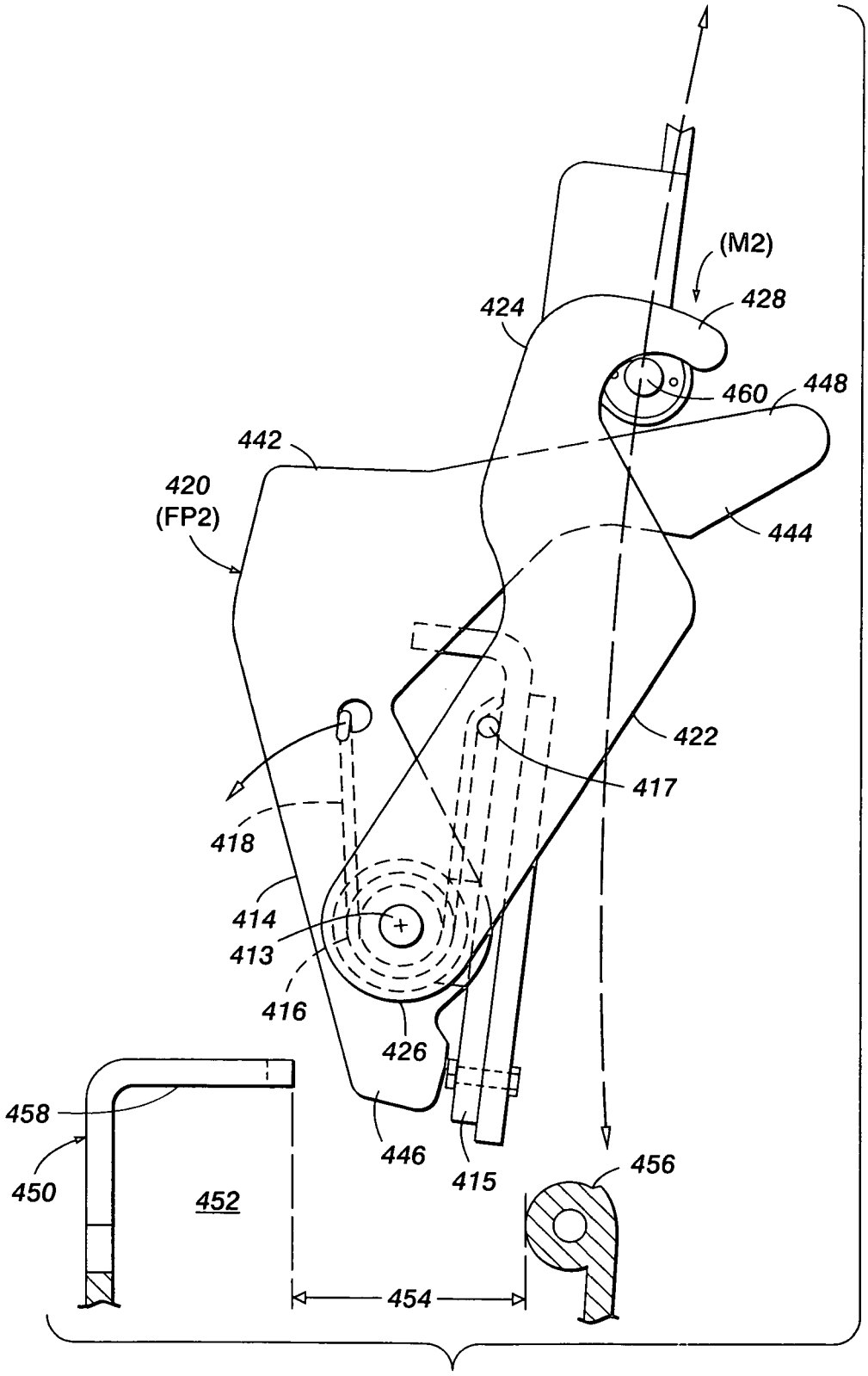
FIG. 7 is a perspective schematic of the gang safety latching mechanism of the present disclosure with both the first bracket and second bracket in their free positions.

Specifically, the first bracket includes a first body 422, a first first end 424 including a first finger 428, and a first second end 426 mounted to the torsion spring subassembly 412 by means a pivot shaft 413. The second bracket 440 similarly includes a second body 441, a second first end 444 including a second finger 448, and a second second end 446 also mounted to the torsion spring subassembly 412 by means of the pivot shaft 413. On the torsion spring and bracket device 410 (as shown in FIG. 5), a first direction D1 of movement of the first bracket 420 from the first loaded position LP1 to the first free position FP1 is opposite to a second direction D2 of movement of the second bracket 440 from the second loaded position LP2 to the second free position FP2. As shown in FIGS. 6 and 7, the first first end 424 of the first bracket 420 and the second first end 444 of the second bracket 440 of the torsion spring and bracket device 410 have an open position M1 away from each other and a closed or locking position M2 proximate each other.

The knocker member 456 of the interference assembly 450 is located on the reference module 212 for contacting and moving the first bracket 420 (against a force of the torsion spring) from the first free position FP1 to the first loaded position LP1 when the end portion 414 of the torsion spring and bracket device 410 is being passed through the opening 454 into the receiving area 452 of the interference assembly. The catch lip 458 of the interference assembly 450 is located for trapping the second bracket 440 (by means of the shoulder portion; 442 of the second bracket) within the receiving area 452 when the second bracket 440 is within the receiving area and in the second free position FP2.

The gang locking member 460 has (i) a first position LD against the second finger 448 of the second bracket 440 that corresponds to a closed position of the second movable module 230 relative to the first movable module 220, and (ii) a second position LU away from the second finger 448 of the second bracket 440. The second position LU corresponds to an open position of the second movable module 230 relative to the first movable module 220.

The torsion spring subassembly 412 includes an attaching member 415 for attaching the torsion spring and bracket device 410 to the first movable module 220. The torsion spring subassembly 412 also includes a torsion spring 416 that is mounted around the pivot shaft 413, and that has a first end 417 for moving the first bracket 420 from the first loaded position LP1 to the first free position FP1, and a second end 418 for moving the second bracket 440 from the second loaded position LP2 to the second free position FP2.

Referring now to FIGS. 2-7, the attaching member 415 of the torsion spring subassembly 412 (of the torsion spring and bracket device 410) is attached to the compiler input transport module 220 (the compiler input transport module here in general is the first module or first body of the plural co-assembled movable modules or bodies). The interference assembly 450 is mounted to the reference module/body or compiler housing 212 at a first aligned location below the torsion spring and bracket device 410 for interacting with the lower or end portion 414 of the torsion spring and bracket device 410 as it passes into and out of the receiving area 452 thereof, as the compiler input transport/first module or body 220 opens and closes relative to the reference module/body or compiler housing 212. The gang locking member 460 is then attached to the bypass transport module 230 (in general the bypass transport module here is a second movable module or body), and at a second aligned location above the torsion spring and bracket device 410 for interacting with the first and second fingers 428, 448 of the first and second brackets 420, 440, as the bypass transport module 230 is opened and closed relative to the compiler input transport module 220.

In operation, when both the first and second co-assembled movable modules, for example the compiler input transport module 220 and the bypass transport module 230 are closed as shown in FIG. 2, the gang safety latching mechanism 400 will assume its second module-releasing posture as shown in FIG. 5. As shown, the end or lower portion 414 will be within the receiving area 452 of the interference assembly 450, the knocker member 456 would have contacted and moved the first bracket 420 into the first loaded position LP1, and the gang locking member 460 will have moved and be holding the second bracket 440 in the second loaded position LP2. In this posture, the first finger 428 of the first bracket 420 is in the open position M1 relative to the second finger 448 of the second bracket 440. As such, the gang locking member 460, and hence the second module 230 to which it is attached, is free to be moved away from the second finger 448 without running into the first finger 428.

Note also (as shown in FIG. 5) that by the second bracket 440 being in the second loaded position LP2, the shoulder portion 442 thereof (within the receiving area 452 of the interference assembly 450) is clear of the catch lip 458. An operator can choose at this point whether to open only the second module 230 (by moving the gang locking member 460 away from the second finger 448) or to keep the first module closed and open the first module 220 (by moving the lower portion 414 of the torsion spring and bracket device 410 out of the receiving area 452).

Figure 3:
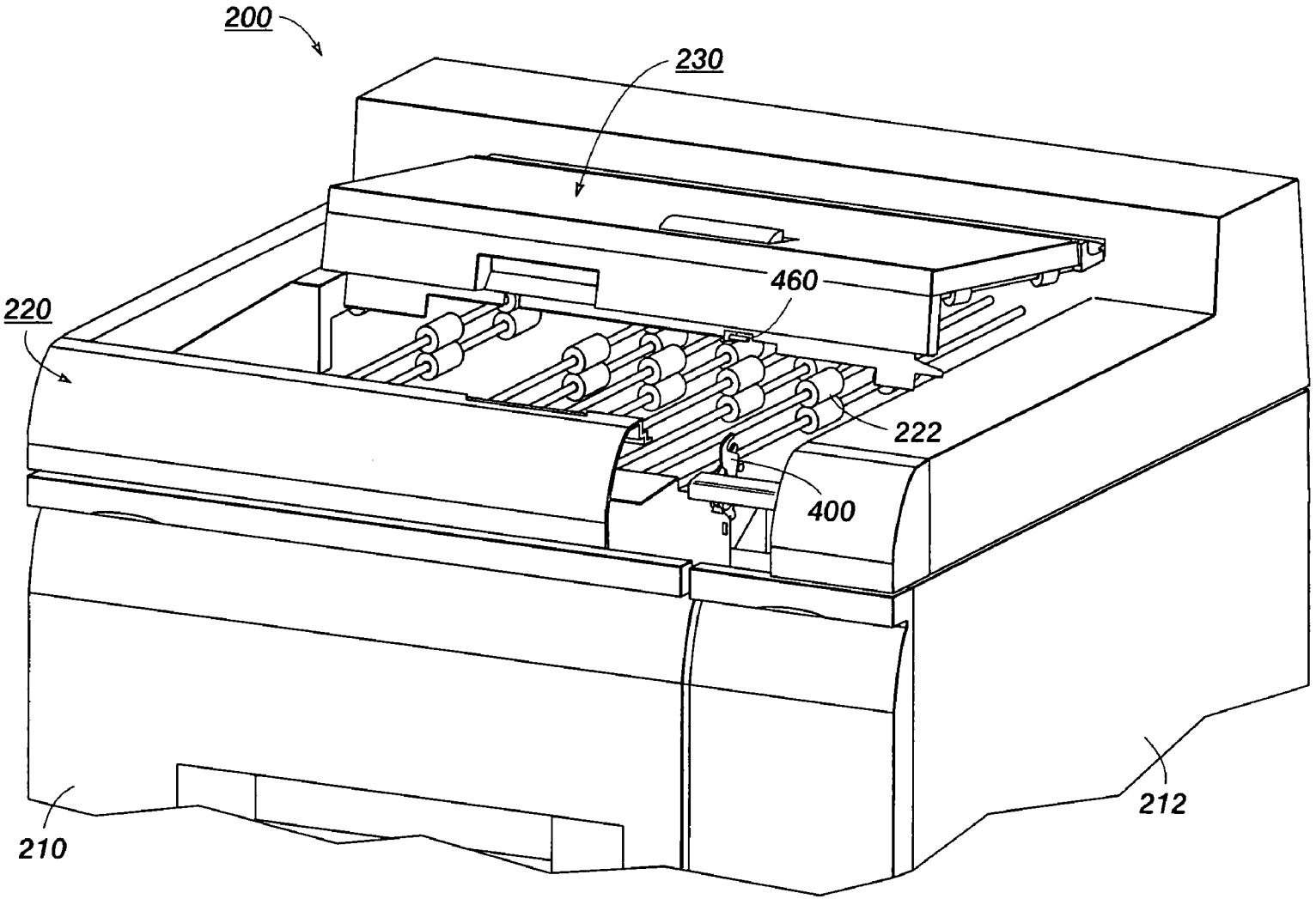
FIG. 3 is a closed up view of the top portion of the compiler section of FIG. 2 showing the co-movable bypass transport module in its open position and the gang safety latching mechanism of the present disclosure.

If the operator chooses to open only the second module 230 (by moving the gang locking member 460 away from the second finger 448) as illustrated in FIGS. 3 and 6, then the second finger 448 of the second bracket 440 will be released from the second loaded position LP2 and immediately move into the second free position FP2 even while the lower portion 414 of the torsion spring and bracket device 410 is still within the receiving area 452 of the interference assembly. As such, the shoulder portion 442 thereof is now no longer clear of the catch lip 458, thereby trapping shoulder portion 442 and the entire torsion spring and bracket device 410 within the receiving area. This prevents the first module 220 from being opened when the second module 230 is opened as here by the operator's choosing.

Figure 4:
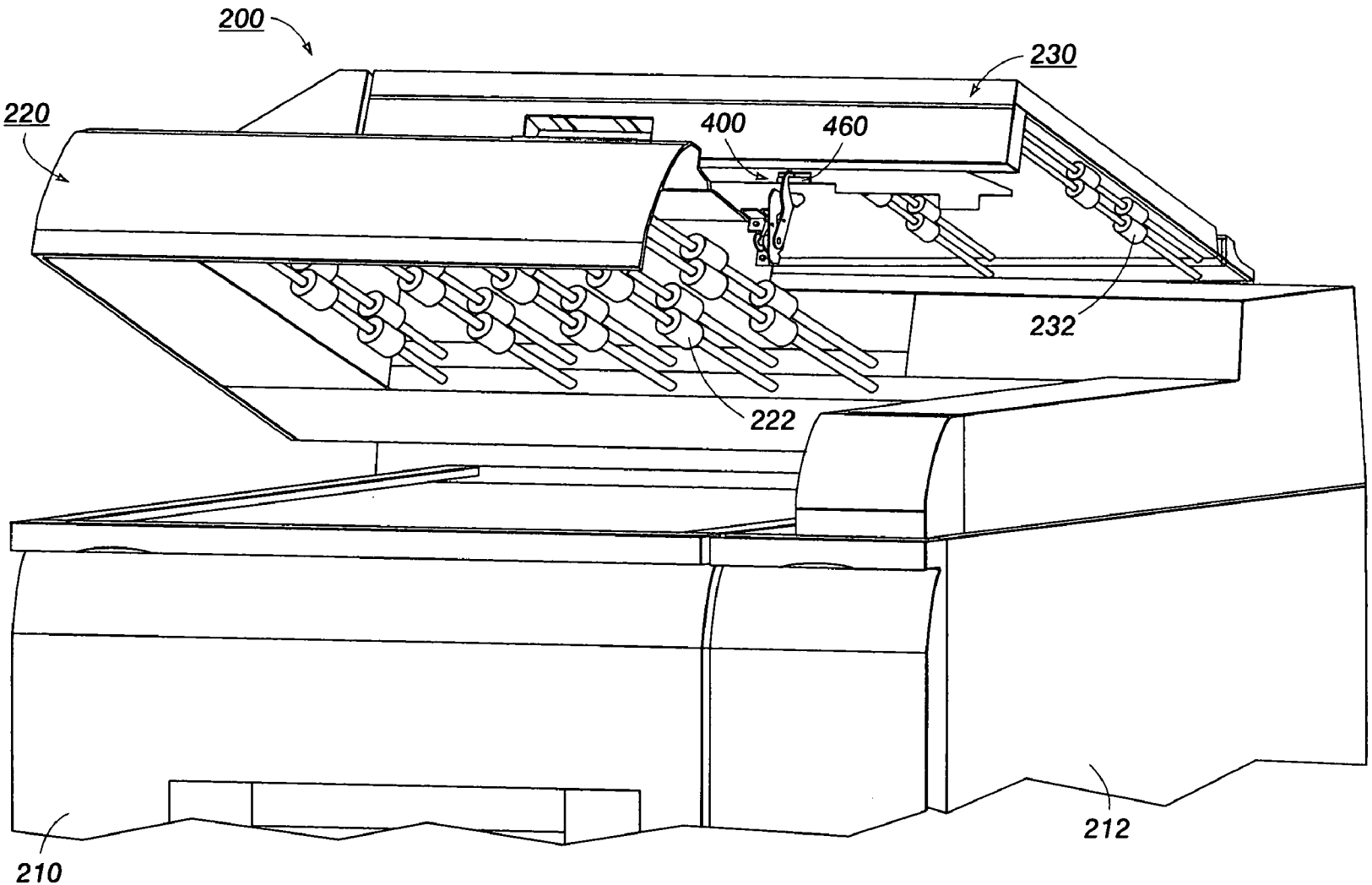
FIG. 4 is also a closed up view of the top portion of the compiler section of FIG. 2 showing both the co-movable compiler input transport module and bypass transport module in their gang open position and the gang safety latching mechanism of the present disclosure.

If however the operator chooses to open the first module 220 (by moving the lower portion 414 of the torsion spring and bracket device 410 out of the receiving area 452) as illustrated in FIGS. 4 and 7, then the gang locking member 460 must be down (position LD) against the second finger 448, thus holding the second bracket in the second loaded position FP2 so that its shoulder portion 442 is clear of the catch lip 458 of the interference assembly 450. At this point, the operator can proceed to open the first module 220 relative to the reference module 212, thus pulling the lower or end portion 414 of the torsion spring and bracket device 410 out of the receiving area 452 of the interference assembly 450. Pulling the lower or end portion 414 as such out of the receiving area immediately frees the first bracket 420 of the holding power of the knocker member 456 of the interference assembly 450, thus allowing it to immediately move from the first loaded position LP1 into the first free position FP1. This brings a claw portion 429 of the first finger 428 into the locking position M2, locking the gang locking member 460 between the first finger 428 and second finger 448. This thus gang locks the second module 230 to the first module 220, as the first module 220 is being opened as here according to the operator's choosing.

As such, the gang safety latching mechanism 400 effectively prevents the first module 220 and the second module 230 (here the compiler input transport module, and the bypass transport module) or in general any co-assembled movable multiple layered modules or paper path transports, from being opened simultaneously and separately. As we have seen, only one transport or module can be opened at any one time.

The gang safety latching mechanism 400 is a compact and reliable dual action mechanism that interacts and reacts mechanically with (a) the bypass; transport or second module or second body 441, (b) the compiler input transport or first module or first body 422 and (c) the compiler housing or reference module or body 212 to accomplish the above sequence of safe control over movement or opening and closing of the co-assembled movable modules wherein one must be closed before the other is opened. This is all accomplished mechanically with no sensors or electrical/software parts required to operate this latching mechanism.

As can be seen, there has been provided a gang safety latching mechanism that includes (a) a torsion spring and bracket device having (i) a torsion spring subassembly (ii) a first bracket on the torsion spring subassembly having a first free position and a first loaded position, and (iii) a second bracket on the torsion spring subassembly having a second free position and a second loaded position; (b) an interference assembly defining a receiving area and including (i) an opening for passage of an end portion of the torsion spring and bracket device into and out of the receiving area, (ii) a knocker member for contacting the first bracket and (iii) a catch lip for trapping the second bracket within the receiving area; and (c) a gang locking member for locking the second bracket to the first bracket, thereby preventing unsafe separate simultaneous movement of the second movable and the first movable module relative to the main machine body.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A gang safety latching mechanism for preventing unsafe separate simultaneous movement of plural co-assembled movable bodies relative to a reference body, the gang safety latching mechanism comprising;

(a) a torsion spring and bracket device including (i) a torsion spring subassembly for attaching to a first movable body of the plural co-assembled movable bodies, (ii) a first bracket mounted onto said torsion spring subassembly, having a first free position and a first loaded position, and being movable between said first free position and said first loaded position, and (iii) a second bracket mounted onto said torsion spring subassembly, having a second free position and a second loaded position, and being movable between said second free position and said second loaded position, and wherein on said torsion spring and bracket device, a first direction of movement of said first bracket from said first loaded position to said first free position is opposite to a second direction of movement of said second bracket from said second loaded position to said second free position;

(b) an interference assembly defining a receiving area, said interference assembly being locatable on the reference body and including (i) an opening for passage of an end portion of said torsion spring and bracket device into and out of said receiving area, (ii) a knocker member for contacting said first bracket when said end portion of said torsion spring and bracket device is passed through said opening; and (iii) a catch lip for trapping said second bracket within said receiving area; and (c) a gang locking member locatable on a second movable body of the plural co-assembled movable bodies for locking said second bracket to said first bracket, thereby gang locking said second movable body to said first movable body, and thereby preventing unsafe separate simultaneous movement of said second movable and said first movable body relative to said reference body.

2. The gang safety latching mechanism of claim 1, wherein said first bracket includes a first main body, a first first end including a first finger, and a first second end mounted to a pivot shaft of said torsion spring subassembly.

3. The gang safety latching mechanism of claim 1, wherein said second bracket includes a second main body, a second first end including a second finger, and a second second end mounted to a pivot shaft of said torsion spring subassembly.

4. The gang safety latching mechanism of claim 1, wherein said torsion spring and bracket assembly includes a torsion spring mounted around a pivot shaft, and has a first end for moving said first bracket from said first loaded position to said first free position, and a second end for moving said second bracket from said second loaded position to said second free position.

5. The gang safety latching mechanism of claim 1, wherein a first first end of said first bracket and a second first end of said second bracket of said torsion spring and bracket assembly have an open position away from each other and a closed position proximate each other.

6. The gang safety latching mechanism of claim 1, wherein said knocker member of said interference assembly is located for contacting and moving said first bracket from said first free position to said first loaded position when said end portion of said torsion spring and bracket device is passed through said opening into said receiving area of said interference assembly.

7. The gang safety latching mechanism of claim 1, wherein said catch lip of said interference assembly is located for trapping said second bracket within said receiving area when said second bracket is within said receiving area and in said second free position.

8. The gang safety latching mechanism of claim 1, wherein said gang locking member has (i) a first position against said second bracket corresponding to a closed position of the second movable body relative to the first movable body, and (ii) a second position away from said second bracket corresponding to an open position of the second movable body relative to the first movable body.

9. The gang safety latching mechanism of claim 1, wherein said torsion spring and bracket subassembly includes an attaching member for attaching said torsion spring and bracket device to the first movable body.

10. An image producing machine comprising (a) a main machine body having image forming and transfer components including a photoreceptor, sheet supply modules and a fusing apparatus;

(b) several modules including a reference module and at least two movable modules co-assembled to said reference module for movement relative to each other and to the reference module; and (c) a gang safety latching mechanism for preventing unsafe separate simultaneous movement of the at least two co-assembled movable modules relative to said reference module, the gang safety latching mechanism comprising;

(x) (a) a torsion spring and bracket device including (i) a torsion spring subassembly for attaching to a first movable module of the plural co-assembled movable modules, (ii) a first bracket mounted onto said torsion spring subassembly, having a first free position and a first loaded position, and being movable between said first free position and said first loaded position, and (iii) a second bracket mounted onto said torsion spring subassembly, having a second free position and a second loaded position, and being movable between said second free position and said second loaded position, and wherein on said torsion spring and bracket device, a first direction of movement of said first bracket from said first loaded position to said first free position is opposite to a second direction of movement of said second bracket from said second loaded position to said second free position;

(y) an interference assembly defining a receiving area, said interference assembly being locatable on said reference module and including (i) an opening for passage of an end portion of said torsion spring and bracket device into and out of said receiving area, (ii) a knocker member for contacting said first bracket when said end portion of said torsion spring and bracket device is passed through said opening; and (iii) a catch lip for trapping said second bracket within said receiving area; and (z) a gang locking member locatable on a second movable module of the plural co-assembled movable modules for locking said second bracket to said first bracket, thereby gang locking said second movable module to said first movable module, and thereby preventing unsafe separate simultaneous movement of said second movable and said first movable module relative to said reference module.

11. The image producing machine of claim 10, wherein said torsion spring and bracket subassembly includes a torsion spring mounted around a pivot shaft, and has a first end for moving said first bracket from said first loaded position to said first free position, and a second end for moving said second bracket from said second loaded position to said second free position.

12. The gang safety latching mechanism of claim 10, wherein said first bracket includes a first body, a first first end including a first finger, and a first second end mounted to a pivot shaft of said torsion spring subassembly.

13. The image producing machine of claim 10, wherein said second bracket includes a second body, a second first end including a second finger, and a second second end mounted to a pivot shaft of said torsion spring subassembly.

14. The image producing machine of claim 10, wherein said torsion spring and bracket subassembly includes an attaching member for attaching said torsion spring and bracket device to the first movable module.

15. The image producing machine of claim 10, wherein a first first end of said first bracket and a second first end of said second bracket of said torsion spring and bracket device have an open position away from each other and a closed position proximate each other.

16. The image producing machine of claim 10, wherein said knocker member of said interference assembly is located for contacting and moving said first bracket from said first free position to said first loaded position when said end portion of said torsion spring and bracket device is passed through said opening into said receiving area of said interference assembly.

17. The image producing machine of claim 10, wherein said catch lip of said interference assembly is located for trapping said second bracket within said receiving area when said second bracket is within said receiving area and in said second free position.

18. The image producing machine of claim 10, wherein said gang locking member has (i) a first position against said second bracket corresponding to a closed position of the second movable module relative to the first movable module, and (ii) a second position away from said second bracket corresponding to an open position of the second movable module relative to the first movable module.

* * * * *